US011781788B2

(12) United States Patent
Liu et al.

(10) Patent No.: US 11,781,788 B2
(45) Date of Patent: Oct. 10, 2023

(54) CASCADE AIR CONDITIONER SYSTEM

(71) Applicant: GREE ELECTRIC APPLIANCES, INC. OF ZHUHAI, Guangdong (CN)

(72) Inventors: Xingru Liu, Guangdong (CN); Xiangfei Liang, Guangdong (CN); Bo Zheng, Guangdong (CN)

(73) Assignee: GREE ELECTRIC APPLIANCES, INC. OF ZHUHAI, Guangdong (CN)

( * ) Notice: Subject to any disclaimer, the term of this patent is extended or adjusted under 35 U.S.C. 154(b) by 329 days.

(21) Appl. No.: 17/293,888

(22) PCT Filed: Sep. 10, 2019

(86) PCT No.: PCT/CN2019/105103
§ 371 (c)(1),
(2) Date: May 13, 2021

(87) PCT Pub. No.: WO2020/098354
PCT Pub. Date: May 22, 2020

(65) Prior Publication Data

US 2022/0011021 A1 Jan. 13, 2022

(30) Foreign Application Priority Data

Nov. 14, 2018 (CN) ..... 201811352233.2

(51) Int. Cl.
*F25B 5/04* (2006.01)
*F24F 11/65* (2018.01)
(Continued)

(52) U.S. Cl.
CPC ..... *F25B 5/04* (2013.01); *F24F 11/65* (2018.01); *F24F 13/30* (2013.01); *F25B 41/30* (2021.01);
(Continued)

(58) Field of Classification Search
CPC .. F25B 5/04; F25B 41/30; F25B 43/00; F25B 2600/2515; F25B 2400/23; F25B 49/02; F24F 11/65; F24F 13/30
See application file for complete search history.

(56) References Cited

U.S. PATENT DOCUMENTS 8,181,478 B2 * 5/2012 Ignatiev ..... F25B 43/02 62/505
2014/0326018 A1 * 11/2014 Ignatiev ..... F25B 49/02 62/527
(Continued)

FOREIGN PATENT DOCUMENTS

CA 3014213 A1 * 3/2019 ..... F25B 1/10
CA 3044575 A1 * 12/2019 ..... F25B 1/10
(Continued)

OTHER PUBLICATIONS

International Search Report and Written Opinion in the international application No. PCT/CN2019/105103, dated Nov. 12, 2019 (with translation) (14 pages).
(Continued)

*Primary Examiner* — Kun Kai Ma
(74) *Attorney, Agent, or Firm* — Perkins Coie LLP

(57) ABSTRACT

Disclosed is a cascade air conditioner system. The cascade air conditioner system includes a compressor (1) having a first gas outlet (11), a second gas outlet (12) and a gas inlet (13); a flash tank (2) having a first flash evaporation port (21), a second flash evaporation port (22), a third flash evaporation port (23), and a fourth flash evaporation port (24); and a condenser evaporator (3) having a first port (31), a second port (32), a third port (33), and a fourth port (34), wherein a first heat exchanger (41) is connected in series between the first gas outlet (11) and the first flash evaporation port (21), the second flash evaporation port (22) is connected via a pipe with the first port (31), the second gas
(Continued)

outlet (12) is connected via a pipe with the fourth flash evaporation port (24), the third flash evaporation port (23) is connected via a pipe with an inlet of a first throttle element (51), an outlet of the first throttle element (51) is connected via a pipe with a second heat exchanger (42) and is connected via a pipe with the third port (33), the second heat exchanger (42) is also connected via a pipe with the second port (32) through a second throttle element (52), and the fourth port (34) is connected via a pipe with the gas inlet (13). In the cascade air conditioner system, a gas-phase refrigerant in the compressor (1) is introduced to the flash tank (2), such that the degree of dryness in the flash tank (2) can be controlled conveniently, thereby enhancing performances of the system.

10 Claims, 3 Drawing Sheets

(51) Int. Cl.
*F25B 41/30* (2021.01)
*F24F 13/30* (2006.01)
*F25B 43/00* (2006.01)

(52) U.S. Cl.
CPC ..... *F25B 43/00* (2013.01); *F25B 2600/2515* (2013.01)

(56) References Cited

U.S. PATENT DOCUMENTS

| | | | | |
|---|---|---|---|---|
| 2017/0051949 | A1* | 2/2017 | Uselton | F25B 7/00 |
| 2017/0051950 | A1* | 2/2017 | Uselton | F25B 40/02 |
| 2017/0074550 | A1* | 3/2017 | Ali | F25B 1/10 |
| 2017/0074567 | A1* | 3/2017 | Ali | F25B 49/02 |
| 2017/0102169 | A1* | 4/2017 | Zimmermann | F25B 49/02 |
| 2017/0138643 | A1* | 5/2017 | Ignatiev | F25B 1/10 |
| 2017/0205120 | A1* | 7/2017 | Ali | F25B 40/00 |
| 2018/0252440 | A1* | 9/2018 | Zha | F25B 40/02 |
| 2019/0264933 | A1* | 8/2019 | Ignatiev | F25B 1/10 |
| 2019/0368784 | A1* | 12/2019 | Zha | F25B 9/006 |

FOREIGN PATENT DOCUMENTS

| | | | | |
|---|---|---|---|---|
| CA | 3171965 | A1 * | 3/2023 | F25B 41/22 |
| CN | 101755175 | A | 6/2010 | |
| CN | 101782289 | A | 7/2010 | |
| CN | 101839579 | A | 9/2010 | |
| CN | 202393074 | U | 8/2012 | |
| CN | 104729135 | A | 6/2015 | |
| CN | 105402979 | B | 3/2016 | |
| CN | 206420180 | U | 8/2017 | |
| CN | 106885389 | A | 5/2018 | |
| CN | 108119955 | A | 6/2018 | |
| CN | 108317761 | A | 7/2018 | |
| CN | 108413638 | A | 8/2018 | |
| CN | 109489289 | A | 3/2019 | |
| EP | 3444541 | A | 2/2019 | |
| EP | 3872416 | A1 * | 9/2021 | F25B 1/10 |
| WO | WO9509335 | A2 | 4/1995 | |
| WO | WO-2011112495 | A2 * | 9/2011 | F25B 9/008 |
| WO | WO-2014031708 | A1 * | 2/2014 | B60H 1/3228 |

OTHER PUBLICATIONS

First Office Action of Chinese Patent Application 201811352233.2, dated Nov. 15, 2019 (with translation) (8 pages).

U.S. Pat. No. 320,309, "Separating and Cooling A Sealing or Lubricating Liquid in Producing Refrigeration," J.J. Suckert, Patented Jun. 16, 1885, 5 pages.

* cited by examiner

CASCADE AIR CONDITIONER SYSTEM

CROSS-REFERENCE TO RELATED APPLICATION

The present application is a U.S. National Phase Entry of International PCT Application No. PCT/CN2019/105103 filed on Sep. 10, 2019, and entitled "CASCADE AIR CONDITIONER SYSTEM," which claims priority to Chinese Patent Application No. 201811352233.2, filed by State Intellectual Property Office of The P.R.C on Nov. 14, 2018, and titled "CASCADE AIR-CONDITIONER SYSTEM", the entire contents of which are incorporated herein by reference.

TECHNICAL FIELD

This application belongs to the field of air conditioning technologies, and more particularly, relates to a cascade air conditioner system.

BACKGROUND

A variety of cycles with excellent performances and simple structures can be constructed by using a component separation characteristic of a mixed working medium, including a self-cascade cycle and a cascade dehumidification cycle. Such cycles can be operated under a working condition of a super-large temperature difference. Such cycles are widely used in large-temperature-difference heat pumps, low-temperature refrigerating, freezing and refrigerating, and double-temperature refrigerators, and other fields due to this advantage. However, a traditional self-cascade system has two fatal problems including difficult control and poor performances. The difficult control is because that a refrigerant of the system coming out of a condenser is in two-phase state, and a degree of dryness of an outlet has a great influence on the performances, but it is extremely difficult to regulate the degree of dryness of the outlet of the condenser, so that the system has poor stability.

SUMMARY

Therefore, a technical problem to be solved by this application is to provide a cascade air conditioner system, wherein a gas-phase refrigerant in a compressor is introduced to a flash tank, such that a degree of dryness in the flash tank can be controlled conveniently, and performances of the system are improved.

In order to solve the above problem, this application provides a cascade air conditioner system for regulating a temperature, which includes a compressor, a flash tank, and a condenser evaporator, wherein the compressor has a first gas outlet, a second gas outlet, and a gas inlet, the flash tank has a first flash evaporation port, a second flash evaporation port, a third flash evaporation port, and a fourth flash evaporation port, the condenser evaporator has a first port, a second port, a third port, and a fourth port, a first heat exchanger is connected in series between the first gas outlet and the first flash evaporation port, the second flash evaporation port is connected via a pipe with the first port, the second gas outlet is connected via a pipe with the fourth flash evaporation port, the third flash evaporation port is connected via a pipe with an inlet of a first throttle element, an outlet of the first throttle element is connected via a pipe with a second heat exchanger and is connected via a pipe with the third port, the second heat exchanger is connected via a pipe with the second port through a second throttle element, and the fourth port is connected via a pipe with the gas inlet.

Optionally, the air conditioner system further includes a third throttle element, wherein the third throttle element is connected in series between the first flash evaporation port and the first heat exchanger.

Optionally, the air conditioner system further includes a third heat exchanger, wherein the third heat exchanger is connected in series on a pipe between the first throttle element and the first flash evaporation port, or the third heat exchanger is connected in series on a pip between the first throttle element and the second heat exchanger.

Optionally, the fourth flash evaporation port is located in a liquid-phase refrigerant accumulation area of the flash tank.

Optionally, the compressor is one of a single-cylinder double-exhaust compressor with an advanced exhaust function or a single-suction double-exhaust double-cylinder compressor.

Optionally, the refrigerant is a non-azeotropic mixed refrigerant.

Optionally, the second flash evaporation port is provided with a flow regulating valve, and/or the third flash evaporation port is provided with a flow regulating valve.

This application further provides a cascade air conditioner system for dehumidifying, which includes a compressor, a flash tank, and a fourth heat exchanger, wherein the compressor has a first gas outlet, a second gas outlet, and a gas inlet, the flash tank has a first flash evaporation port, a second flash evaporation port, a third flash evaporation port, and a fourth flash evaporation port, the first gas outlet is connected via a pipe with an inlet of a first heat exchanger, an outlet of the first heat exchanger is connected via a pipe with the first flash evaporation port, the second gas outlet is connected via a pipe with the fourth flash evaporation port, the second flash evaporation port passes through the fourth heat exchanger and a second throttle element in sequence to be connected via a pipe with an inlet of the second heat exchanger, an outlet of the second heat exchanger is connected in parallel with an inlet of the third heat exchanger and is connected via a pipe with the third flash evaporation port through a first throttle element, an outlet of the third heat exchanger is connected via a pipe with the gas inlet, and the third heat exchanger, the second heat exchanger, the fourth heat exchanger, and the first heat exchanger are arranged along a gas flow direction in sequence.

Optionally, the air conditioner system further includes a third throttle element, wherein the third throttle element is connected in series between the first flash evaporation port and the first heat exchanger.

Optionally, the third heat exchanger, the second heat exchanger, the fourth heat exchanger, and the first heat exchanger are respectively located in different gas channels.

According to the cascade air conditioner system provided by this application, partial medium-temperature and medium-pressure gaseous refrigerant generated by the compressor directly enters the flash tank through the second gas outlet, the high-temperature and high-pressure gaseous refrigerant generated by the compressor enters the first heat exchanger (i.e., the condenser) through the first gas outlet for full heat exchange and condensation to form a high-pressure supercooled liquid refrigerant, which then enters the flash tank. Since a supercooled state of the first heat exchanger is more convenient to control, which means that a proportion of the gas-phase refrigerant (an amount of the gas-phase refrigerant) in the flash tank may be flexibly controlled by a discharge amount of the second gas outlet at the moment, and the first heat exchanger may directly control an outflow refrigerant to be a full liquid-phase refrigerant. Therefore, the liquid-phase refrigerant and the gas-phase refrigerant are subjected to full contact heat and mass exchange in the flash tank, such that a degree of dryness in the flash tank may be controlled more conveniently, which means that the refrigerant of the outlet thereof needs to be ensured to be liquid-phase only without needing to control a degree of dryness of the outlet of the first heat exchanger, thereby greatly reducing a control difficulty of the system, and optimizing a performance of the system.

REFERENCE NUMERALS ARE REPRESENTED AS FOLLOWS

Figure 1:
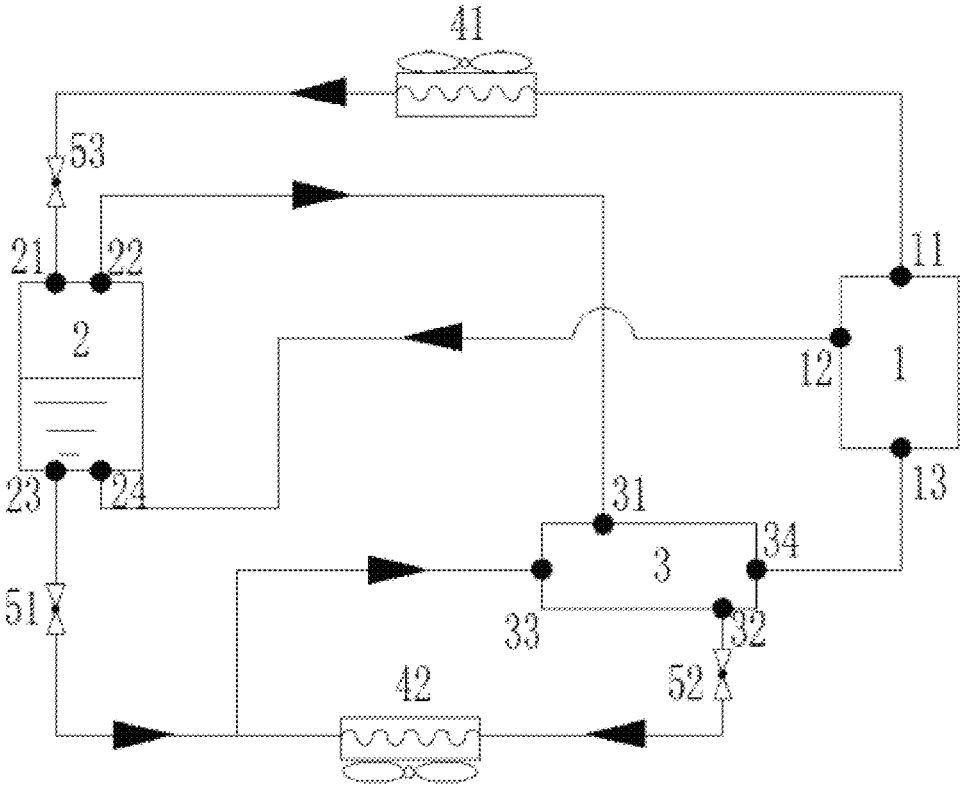
FIG. 1 is a principle diagram of a cascade air conditioner system according to an embodiment of this application.

1 refers to compressor; 11 refers to first gas outlet; 12 refers to second gas outlet; 13 refers to gas inlet; 2 refers to flash tank; 21 refers to first flash evaporation port; 22 refers to second flash evaporation port; 23 refers to third flash evaporation port; 24 refers to fourth flash evaporation port; 3 refers to condenser evaporator; 31 refers to first port; 32 refers to second port; 33 refers to third mouth; 34 refers to fourth mouth; 41 refers to first heat exchanger; 42 refers to second heat exchanger; 43 refers to third heat exchanger; 44 refers to fourth heat exchanger; 51 refers to first throttle element; 52 refers to second throttle element; and 53 refers to third throttle element.

DETAILED DESCRIPTION

With reference to FIG. 1 to FIG. 4, according to an embodiment of this application, a cascade air conditioner system for regulating a temperature is provided, which includes a compressor 1, a flash tank 2, and a condenser evaporator 3. The compressor 1 has a first gas outlet 11, a second gas outlet 12, and a gas inlet 13. The flash tank 2 has a first flash evaporation port 21, a second flash evaporation port 22, a third flash evaporation port 23, and a fourth flash evaporation port 24. The condenser evaporator 3 has a first port 31, a second port 32, a third port 33, and a fourth port 34. A first heat exchanger 41 is connected in series between the first gas outlet 11 and the first flash evaporation port 21, the second flash evaporation port 22 is connected via a pipe with the first port 31, the second gas outlet 12 is connected via a pipe with the fourth flash evaporation port 24, the third flash evaporation port 23 is connected via a pipe with an inlet of a first throttle element 51, an outlet of the first throttle element 51 is connected via a pipe with a second heat exchanger 42 and is connected via a pipe with the third port 33, the second heat exchanger 42 is connected via a pipe with the second port 32 through a second throttle element 52, and the fourth port 34 is connected via a pipe with the gas inlet 13. In the technical solution, partial medium-temperature and medium-pressure gaseous refrigerant generated by the compressor 1 directly enters the flash tank 2 through the second gas outlet 12, the high-temperature and high-pressure gaseous refrigerant generated by the compressor 1 enters the first heat exchanger 41 (i.e., the condenser) through the first gas outlet 11 for full heat exchange and condensation to form a high-pressure supercooled liquid refrigerant, which then enters the flash tank 2. Since a supercooled state of the first heat exchanger 41 is more convenient to control, which means that a proportion of the gas-phase refrigerant (an amount of the gas-phase refrigerant) in the flash tank 2 may be flexibly controlled by a discharge amount of the second gas outlet 12 at the moment, and the first heat exchanger 41 may directly control an outflow refrigerant to be a full liquid-phase refrigerant. Therefore, the liquid-phase refrigerant and the gas-phase refrigerant are subjected to full-contact heat and mass exchange in the flash tank 2, such that a degree of dryness in the flash tank 2 may be controlled more conveniently, which means that the refrigerant of the outlet thereof needs to be ensured to be liquid-phase only without needing to control a degree of dryness of the outlet of the first heat exchanger 41, thereby greatly reducing a control difficulty of the system, and optimizing a performance of the system.

It can be seen from the foregoing that a pressure at the second gas outlet 12 and a pressure in the flash tank 2 are kept consistent according to a principle of a connector formed by pipe connection. In order to ensure smooth circulation of a refrigerant in a corresponding branch and prevent the refrigerant in the flash tank 2 from flowing backwards into the compressor 1, optionally, the air conditioner system further includes a third throttle element 53, and the third throttle element 53 is connected in series between the first flash evaporation port 21 and the first heat exchanger 41. At the moment, although the third throttle element 53 will partially vaporize a liquid-phase refrigerant flowing out of the first heat exchanger 41, a pressure of the refrigerant in the flash tank 2 can be effectively reduced. FIG. 1 shows a circulating direction of the refrigerant (arrows in the figure) during running of the system. At the moment, the illustrated air conditioner system forms a single-temperature self-cascade air conditioner system, wherein the second heat exchanger 42 is equivalent to an evaporator.

Figure 2:
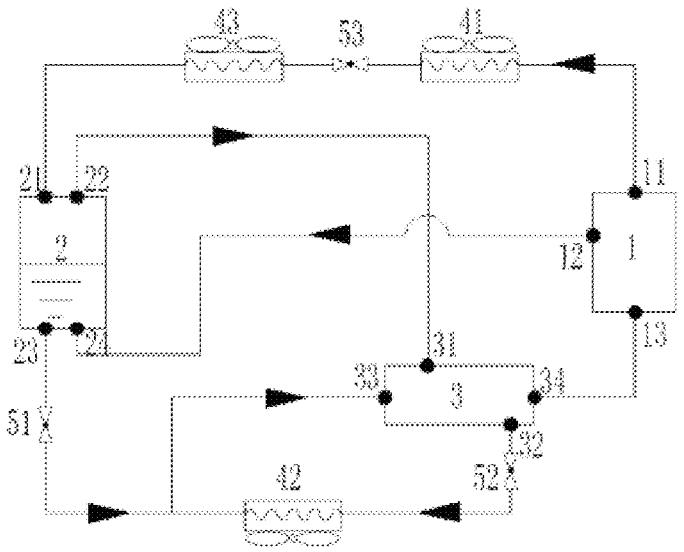
FIG. 2 is a principle diagram of a cascade air conditioner system according to another embodiment of this application.
Figure 3:
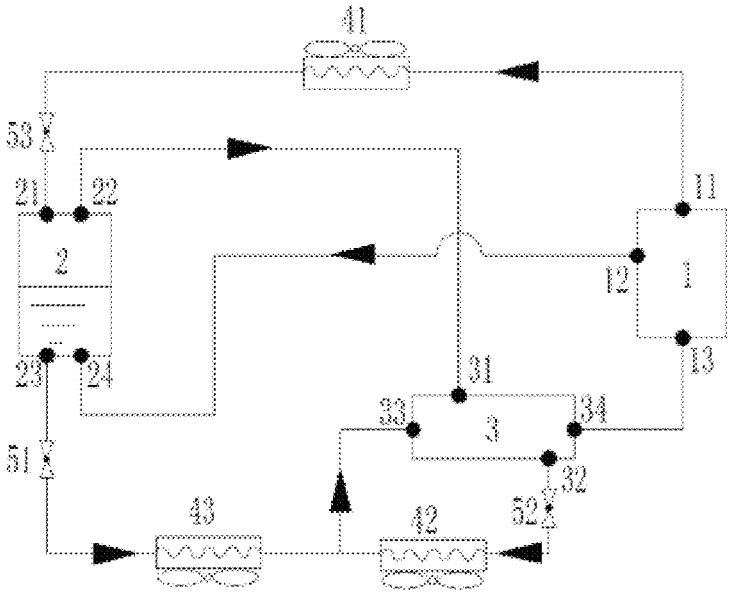
FIG. 3 is a principle diagram of a cascade air conditioner system according to yet another embodiment of this application.

Further, the cascade air conditioner system further includes a third heat exchanger 43, wherein the third heat exchanger 43 is connected in series on a pipe between the first throttle element 51 and the first flash evaporation port 21, or the third heat exchanger 43 is connected in series on a pip between the first throttle element 51 and the second heat exchanger 42. FIG. 2 or FIG. 3 shows a circulating direction of the refrigerant (arrows in the figure) during running of the system. At the moment, the illustrated air conditioner system forms a dual-temperature self-cascade air conditioner system, wherein the second heat exchanger 42 and the third heat exchanger 43 are equivalent to evaporators, and a temperature of the refrigerant in the second heat exchanger 42 is lower than that of the refrigerant in the third heat exchanger 43.

Preferably, the fourth flash evaporation port 24 is located in a liquid-phase refrigerant accumulation area of the flash tank 2. At the moment, the gas-phase refrigerant introduced through the second gas outlet 12 will be subjected to reciprocal contact heat and mass exchange with the liquid-phase refrigerant in the liquid-phase refrigerant accumulation area, and this heat exchange mode has higher exchange efficiency.

Optionally, the refrigerant is a non-azeotropic mixed refrigerant.

In theory, the compressor 1 may adopt any compressor with two or more gas outlets. Optionally, the compressor 1 is one of a double-exhaust compressor with an advanced exhaust function or a single-suction double-exhaust compressor.

Figure 4:
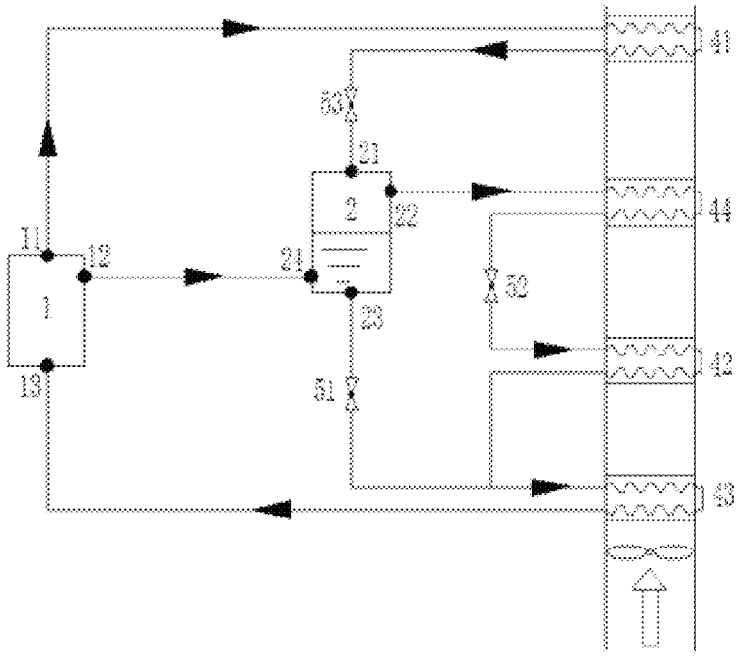
FIG. 4 is a principle diagram of a cascade air conditioner system according to yet still another embodiment of this application.

In order to more accurately regulate a flow ratio of the refrigerant flowing into the first flash evaporation port 21 and the fourth flash evaporation port 24, optionally, the second flash evaporation port 22 is provided with a flow regulating valve, and/or the third flash evaporation port is provided with a flow regulating valve. This application further provides a cascade air conditioner system for dehumidifying, which includes a compressor 1, a flash tank 2, and a fourth heat exchanger 44. The compressor has a first gas outlet 11, a second gas outlet 12, and a gas inlet 13. The flash tank 2 has a first flash evaporation port 21, a second flash evaporation port 22, a third flash evaporation port 23, and a fourth flash evaporation port 24. The first gas outlet 11 is connected via a pipe with an inlet of a first heat exchanger 41, an outlet of the first heat exchanger 41 is connected via a pipe with the first flash evaporation port 21, the second gas outlet 12 is connected via a pipe with the fourth flash evaporation port 24, the second flash evaporation port 22 passes through the fourth heat exchanger 44 and a second throttle element 52 in sequence to be connected via a pipe with an inlet of the second heat exchanger 42, an outlet of the second heat exchanger 42 is connected in parallel with an inlet of the third heat exchanger 43 and is connected via a pipe with the third flash evaporation port 23 through a first throttle element 51, and an outlet of the third heat exchanger 43 is connected via a pipe with the gas inlet 13. The third heat exchanger 43, the second heat exchanger 42, the fourth heat exchanger 44, and the first heat exchanger 41 are arranged along a gas flow direction in sequence. FIG. 4 shows a circulating direction of the refrigerant (arrows in the figure) during running of the system. At the moment, the illustrated air conditioner system forms a cascade dehumidification system, wherein the second heat exchanger 42 and the third heat exchanger 43 are equivalent to evaporators, and a regulated temperature difference of a gas temperature by the second heat exchanger 42 is greater than a regulated temperature difference of a gas temperature by the third heat exchanger 43. The first heat exchanger 41 and the fourth heat exchanger 44 are equivalent to condensers, and a humid gas flow will be dried and cooled when passing through the third heat exchanger 43 and the second heat exchanger 42, and will be heated again after passing through the fourth heat exchanger 44 or the first heat exchanger 41. Thus, it can be seen that when the third heat exchanger 43, the second heat exchanger 42, the fourth heat exchanger 44, and the first heat exchanger 41 are respectively located in a same gas channel, a gas flow will be dehumidified.

Certainly, when the third heat exchanger 43, the second heat exchanger 42, the fourth heat exchanger 44, and the first heat exchanger 41 are respectively located in different gas channels, requirements of various working conditions such as dehumidification, refrigeration, and heating can be met. Similar to the above air conditioner system for regulating the temperature, the cascade air conditioner system further includes a third throttle element 53, wherein the third throttle element 53 is connected in series between the first flash evaporation port 21 and the first heat exchanger 41.

It is easily understood by those skilled in the art that the above advantageous modes can be freely combined and superimposed on the premise of no conflict.

Those described above are merely preferred embodiments of this application, but are not intended to limit this application. Any modifications, equivalent substitutions and improvements made without departing from the spirit and principle of this application shall all fall in the scope of protection of this application. Those described above are merely preferred implementations of this application. It should be noted that those of ordinary skills in the art may further make a plurality of improvements and decorations without departing from the technical principle of this application, and these improvements and decorations shall also fall within the scope of protection of this application.

The invention claimed is:

1. A cascade air conditioner system for regulating a temperature, comprising a compressor, a flash tank, and a condenser evaporator, wherein the compressor has a first gas outlet, a second gas outlet and a gas inlet, the flash tank has a first flash evaporation port, a second flash evaporation port, a third flash evaporation port, and a fourth flash evaporation port, the condenser evaporator has a first port, a second port, a third port, and a fourth port, a first heat exchanger is connected in series between the first gas outlet and the first flash evaporation port, the second flash evaporation port is connected via a pipe with the first port, the second gas outlet is connected via a pipe with the fourth flash evaporation port, the third flash evaporation port is connected via a pipe with an inlet of a first throttle element, an outlet of the first throttle element is connected via a pipe with a second heat exchanger and is connected via a pipe with the third port, the second heat exchanger is connected via a pipe with the second port through a second throttle element, and the fourth port is connected via a pipe with the gas inlet.

2. The air conditioner system according to claim 1, further comprising a third throttle element, wherein the third throttle element is connected in series between the first flash evaporation port and the first heat exchanger.

3. The air conditioner system according to claim 1, further comprising a third heat exchanger, wherein the third heat exchanger is connected in series on a pipe between the first throttle element and the first flash evaporation port, or the third heat exchanger is connected in series on a pipe between the first throttle element and the second heat exchanger.

4. The air conditioner system according to claim 1, wherein the fourth flash evaporation port is located in a liquid-phase refrigerant accumulation area of the flash tank.

5. The air conditioner system according to claim 1, wherein the compressor is one of a single-cylinder double-exhaust compressor with an advanced exhaust function or a single-suction double-exhaust double-cylinder compressor.

6. The air conditioner system according to claim 1, wherein the refrigerant is a non-azeotropic mixed refrigerant.

7. The air conditioner system according to claim 1, wherein the second flash evaporation port is provided with a flow regulating valve, and/or the third flash evaporation port is provided with a flow regulating valve.

8. A cascade air conditioner system for dehumidifying, comprising a compressor, a flash tank, and a fourth heat exchanger, wherein the compressor has a first gas outlet, a second gas outlet, and a gas inlet, the flash tank has a first flash evaporation port, a second flash evaporation port, a third flash evaporation port, and a fourth flash evaporation port, the first gas outlet is connected via a pipe with an inlet of a first heat exchanger, an outlet of the first heat exchanger is connected via a pipe with the first flash evaporation port, the second gas outlet is connected via a pipe with the fourth flash evaporation port, the second flash evaporation port passes through the fourth heat exchanger and a second throttle element in sequence to be connected via a pipe with an inlet of a second heat exchanger, an outlet of the second heat exchanger is connected in parallel with an inlet of a third heat exchanger and is connected via a pipe with the third flash evaporation port through a first throttle element, an outlet of the third heat exchanger is connected via a pipe with the gas inlet, and the third heat exchanger, the second heat exchanger, the fourth heat exchanger, and the first heat exchanger are arranged along a gas flow direction in sequence.

9. The air conditioner system according to claim 8, further comprising a third throttle element, wherein the third throttle element is connected in series between the first flash evaporation port and the first heat exchanger.

10. The air conditioner system according to claim 8, wherein the third heat exchanger, the second heat exchanger, the fourth heat exchanger, and the first heat exchanger are respectively located in different gas channels.

* * * * *